United States Patent [19]

Smiltneek

[11] 3,994,490

[45] Nov. 30, 1976

[54] SHEET FEEDING MECHANISM

[75] Inventor: Ralmond J. Smiltneek, Butler, Wis.

[73] Assignee: Uniplex, Inc., Butler, Wis.

[22] Filed: May 30, 1975

[21] Appl. No.: 582,186

[52] U.S. Cl. ..... 271/136; 271/102; 271/108; 271/132

[51] Int. Cl.[2] ..... B65H 3/12

[58] Field of Search ..... 271/99, 102, 107, 108, 271/132, 136, 139

[56] References Cited

UNITED STATES PATENTS

| | | | |
|---|---|---|---|
| 2,331,533 | 10/1943 | Bishop | 271/99 |
| 2,422,783 | 6/1947 | Jacobson | 271/136 |
| 2,956,804 | 10/1960 | Ridenour | 271/108 |
| 3,421,753 | 1/1969 | Staples, Jr. | 271/108 |

*Primary Examiner*—Robert W. Saifer
*Attorney, Agent, or Firm*—Fred Wiviott

[57] ABSTRACT

A mechanism for feeding blanks or corrugated cardboard and the like into a printing and container forming machine. The feeding mechanism includes a perforated suction head for moving individual sheets from a stack of sheets into the machine. The suction head is mounted on a hollow reciprocating shuttle. A valve connects the shuttle to an evacuator and is actuable by a cam contoured such that the valve may be actuated each time the suction head cycles, during alternate suction head cycles or may remain inactive by varying the angular orientation of the cam and the cam follower coupled to the valve. In an alternate embodiment these variations of vacuum application to suction head cycling are provided by a valve having rotating members wherein the relative speed of the members may be adjusted to provide the control functions.

39 Claims, 18 Drawing Figures

FIG. 4
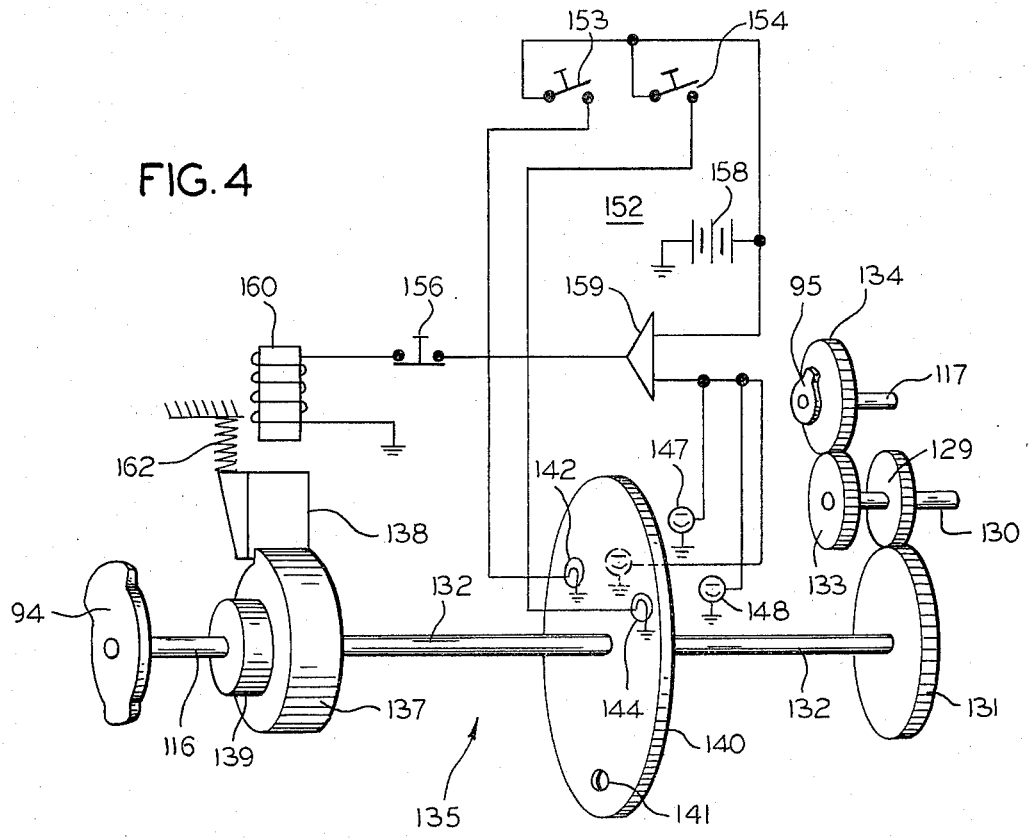
FIG. 5
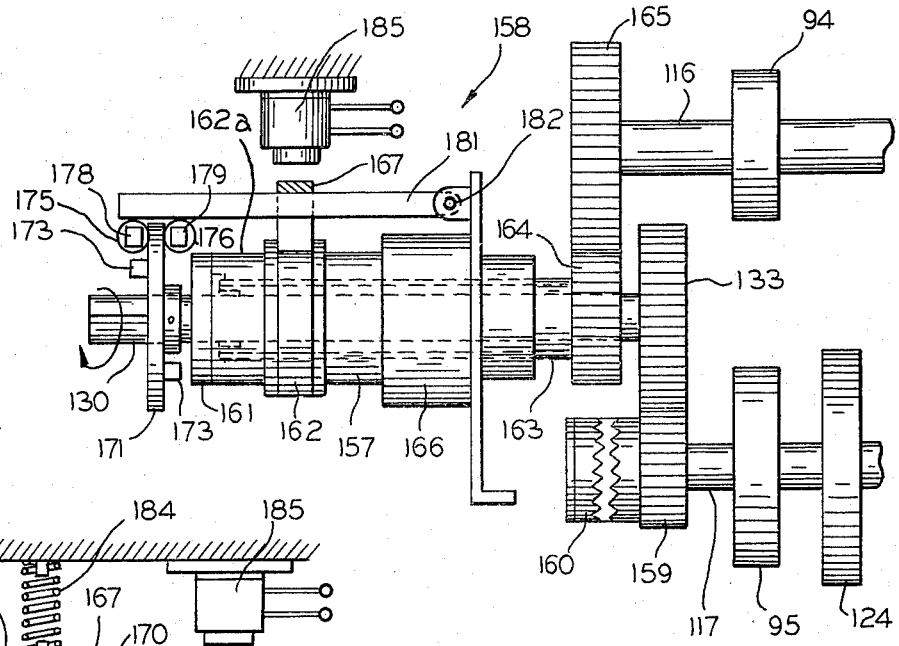
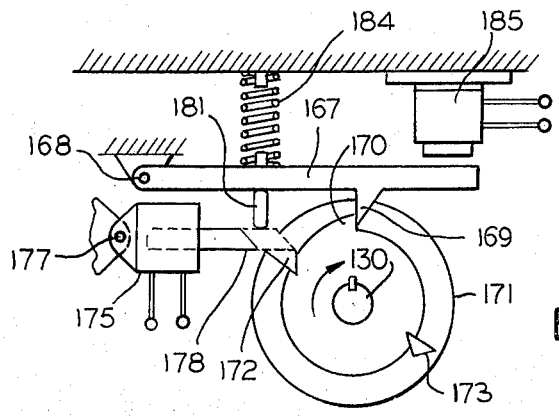
FIG. 6

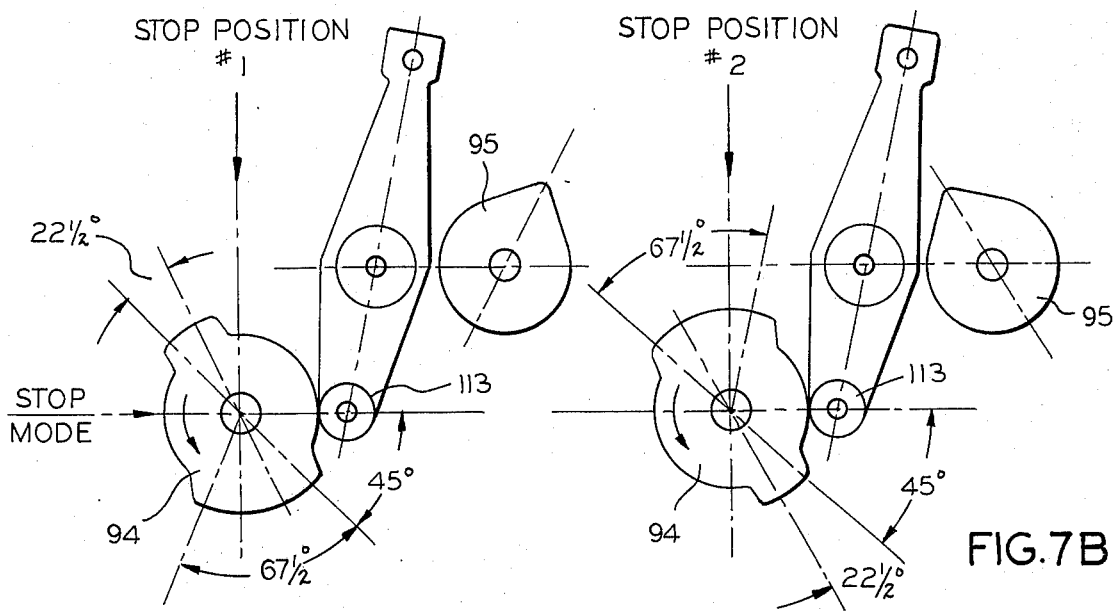
FIG.7A
FIG.7B
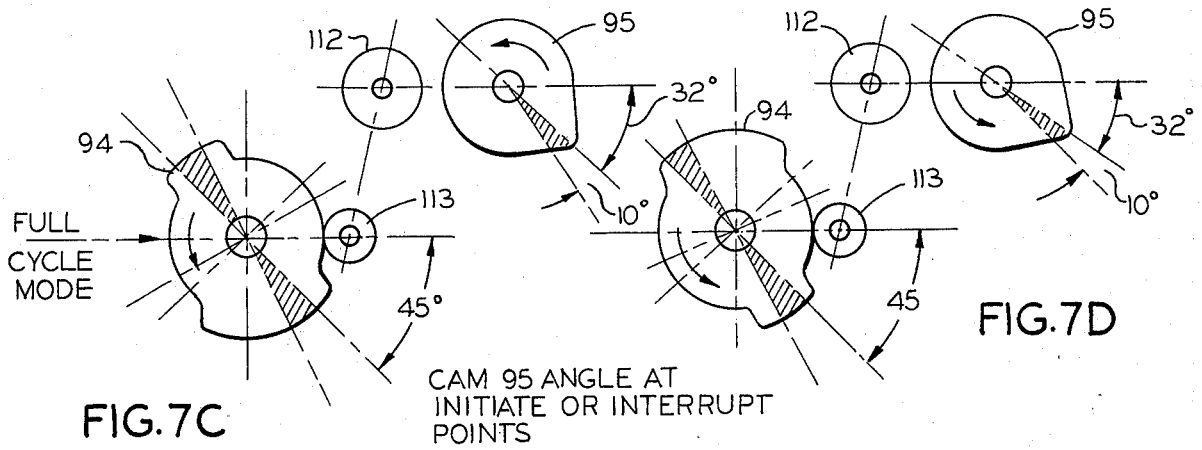
FIG.7C
FIG.7D
CAM 95 ANGLE AT INITIATE OR INTERRUPT POINTS
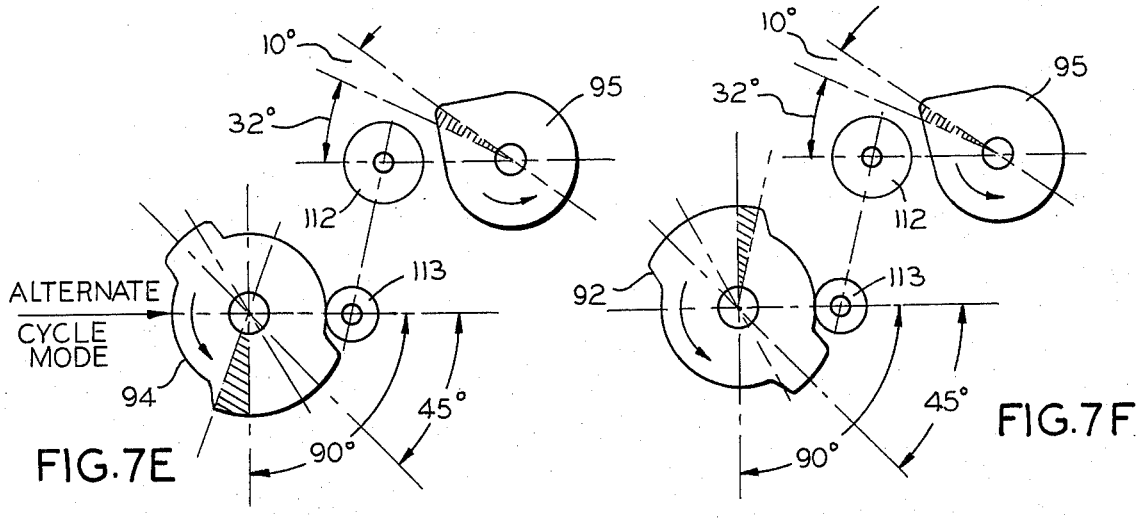
FIG.7E
FIG.7F
CAM 95 ANGLE AT INITIATE OR INTERRUPT POINTS

SHEET FEEDING MECHANISM

BACKGROUND OF THE INVENTION

This invention relates to sheet feeding apparatus and more particularly to apparatus for feeding blanks of corrugated cardboard and the like into printing and container fabricating machinery.

In the fabrication of containers of materials such as corrugated cardboard, container blanks are individually fed into fabrication machinery where they may be printed, die cut, folded and/or glued. Such feeders commonly feed the blanks from the bottom of a stack which is bulk loaded on a feeding table and apparatus are provided for sequentially feeding the sheets into the machine from the bottom of the stack. One type of such feeding mechanism includes a perforated suction head carried on a hollow shuttle. Such shuttles are normally located adjacent to the fabricating machinery nip rolls and below the stack of blanks. The shuttle is commonly cycled back and forth toward the nip rolls while vacuum is initially applied to the interior of the shuttle for gripping the lowermost blank when the shuttle is in its rearmost position and the hollow shuttle interior is vented as it moves toward a forward position for releasing the blank whereupon it may be engaged by the nip rolls for movement into the fabricating machinery.

In prior art apparatus, of this type the shuttle was commonly coupled to the machine prime mover and was directly related to machine speed. Similarly, valves which were operable to couple the shuttle to the vacuum system were also mechanically coupled to the machine main drive. For this reason, prior art apparatus lacked flexibility in that the vacuum was applied to the shuttle for each cycle thereof.

SUMMARY OF THE INVENTION

It is an object of the invention to provide a new and improved suction blank feeder.

Another object of the invention is to provide a suction type blank feeder for container fabricating machinery wherein vacuum application may be varied with respect to the feeder operating cycle.

A further object of the invention is to provide apparatus for feeding relatively long blanks into a container fabricating apparatus.

Yet another object of the invention is to provide a new and improved valve assembly for suction blank feeding apparatus.

A still further object of the invention is to provide a suction feeder which is operative to initiate a feeding operation during each cycle of the feeder or during alternate cycles thereof.

Yet another object of the invention is to provide a suction feeder wherein a feeding operation can be prevented while the feeder cycles.

These and other objects and advantages of the invention will become more apparent from the detailed description thereof taken with the accompanying drawings.

Figure 1:
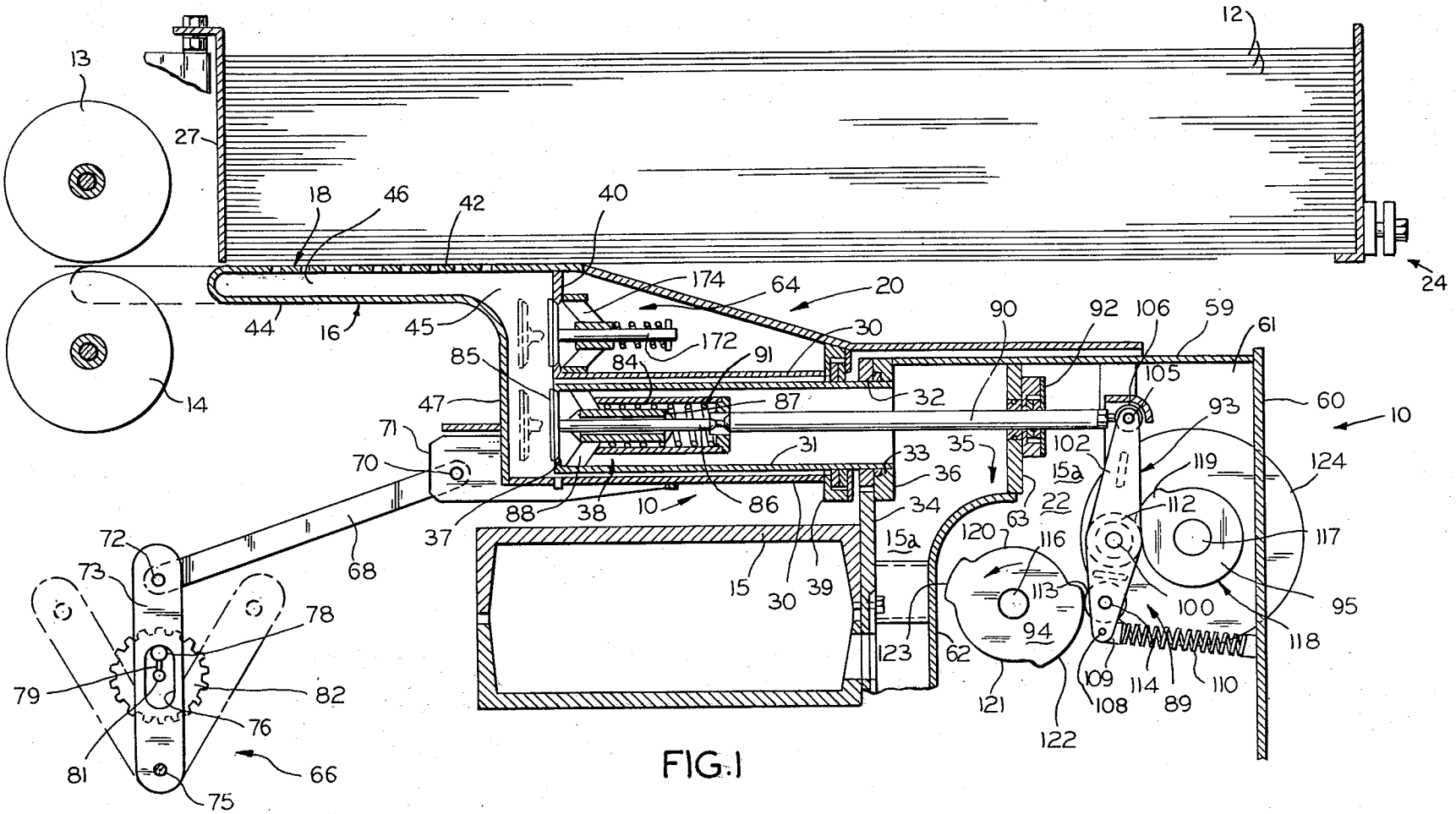
FIG. 1 is a side elevational view of a sheet feed mechanism according to a preferred embodiment of the invention.
Figure 2:
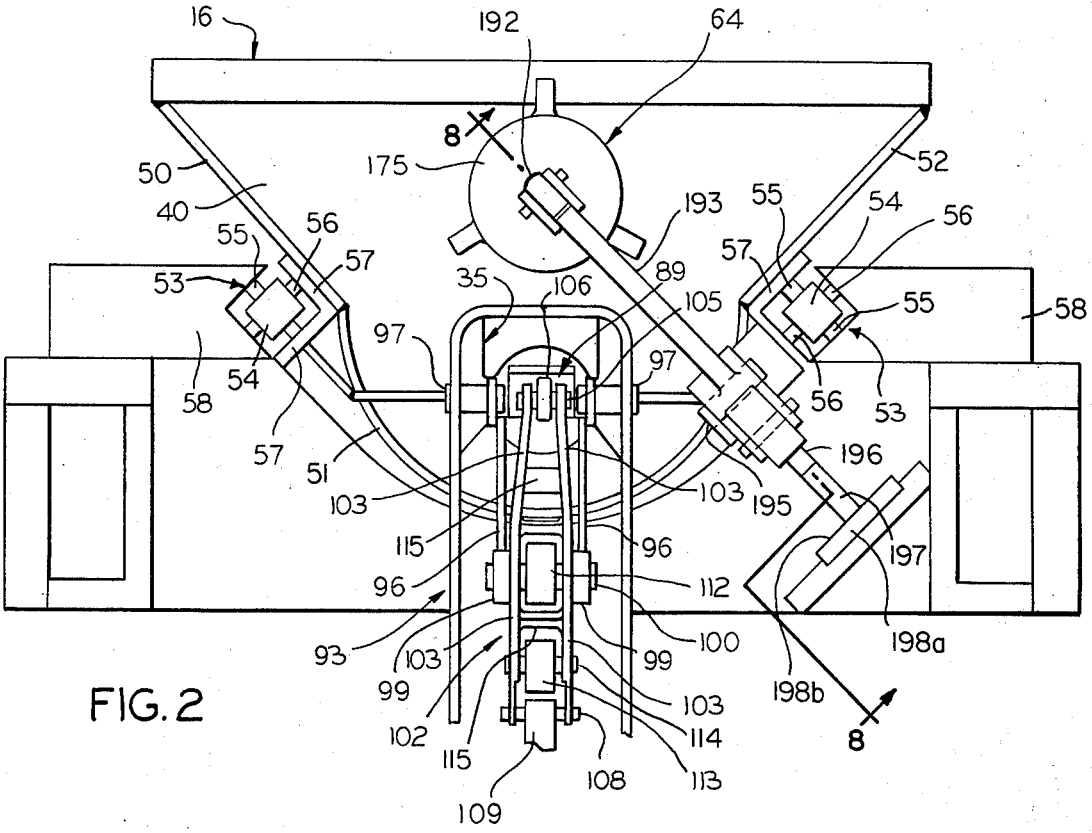
FIG. 2 is a front view of a portion of the apparatus shown in FIG. 1.
Figure 8:
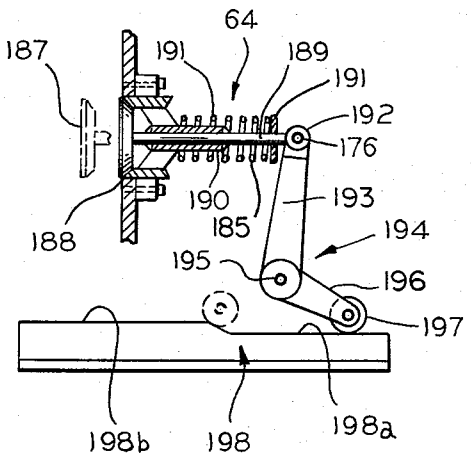
Figure 9:
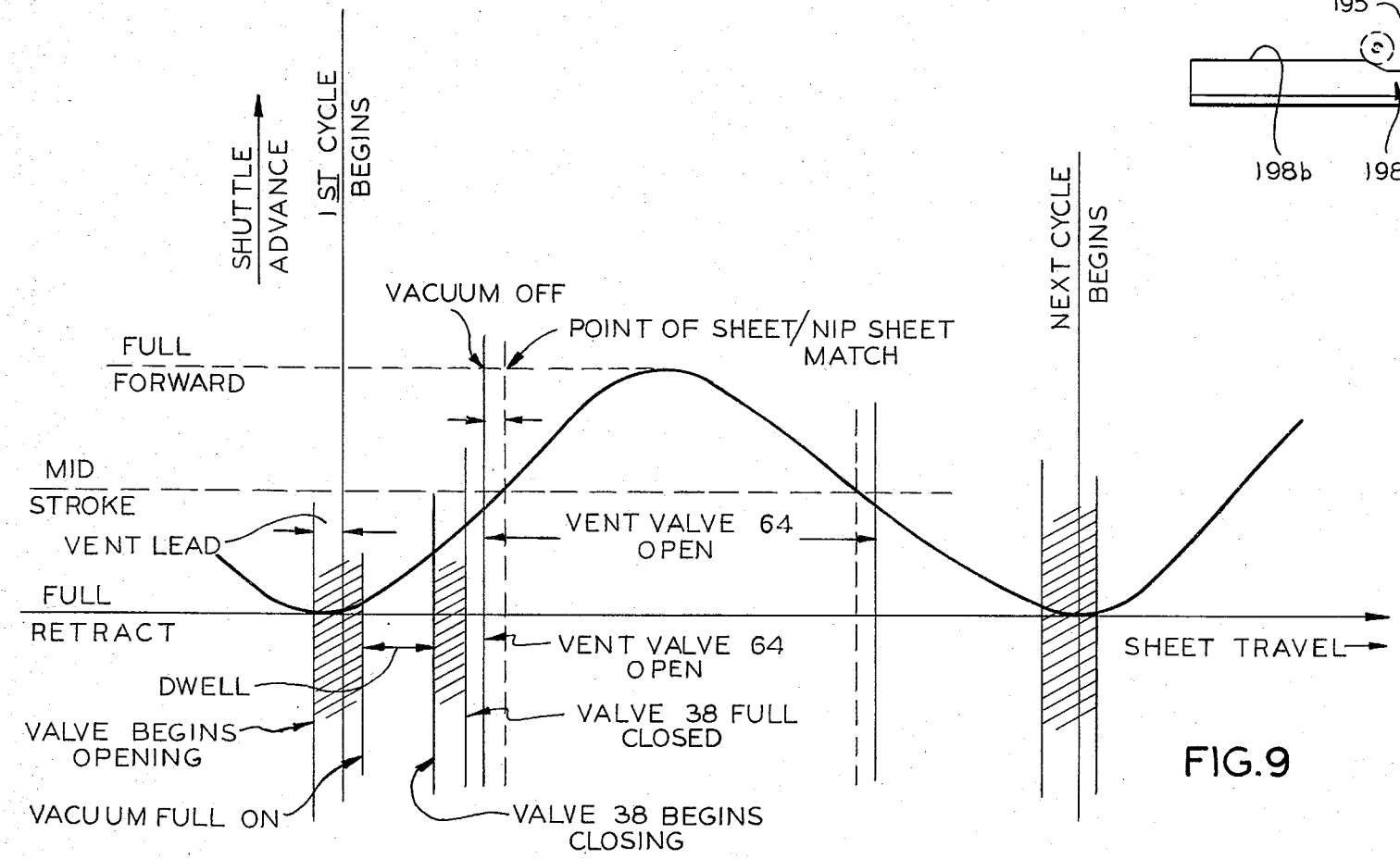
Figure 11:
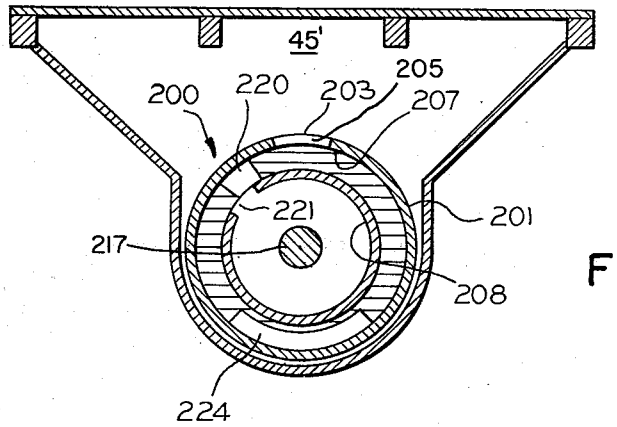
Figure 10:
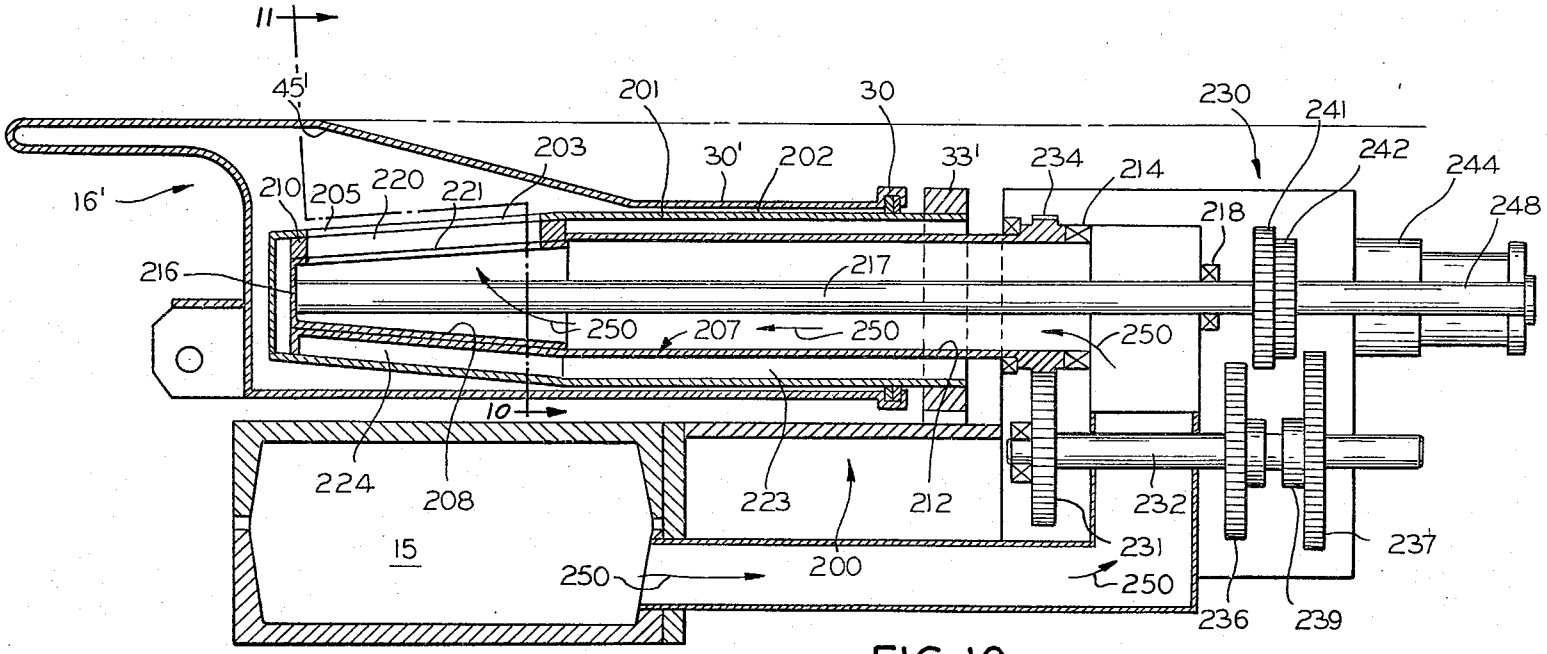

FIGS. *3a*, *3b* and *3c* schematically illustrate the modes of operation of the apparatus of FIG. 1;

FIG. 4 schematically illustrates the control mechanism for achieving the modes of operation illustrated in FIGS. *3a*, *3b*, and *3c*;

FIGS. 5 and 6 schematically illustrate an alternate embodiment of the control mechanism for achieving the various modes of operation;

FIG. 2A–7F illustrate the various angular positions of the operating mechanism effectuated by the mode operations of the control mechanism shown in FIGS. 5 and 6;

FIG. 8 is a view taken along lines 8—8 of FIG. 2;

FIG. 9 shows the relationship between shuttle travel and valve operation in the apparatus of FIG. 1;

FIG. 10 is a side elevational view partly in section of an alternate embodiment of the invention; and FIG. 11 is a view taken along lines 10—10 of FIG. 10.

DETAILED DESCRIPTION OF THE PREFERRED EMBODIMENTS

FIG. 1 schematically illustrates the feeding mechanism 10 for feeding blanks 12 of corrugated cardboard from a stack of such blanks to the feed rolls 13 and 14 of processing apparatus (not shown) which may, for example, print, cut or fold the blanks 12 into cartons. The feeding mechanism 10 is supported on a box suction tank 15 which also forms a part of the support for mechanism 10, and includes a reciprocating shuttle assembly 16 having a suction head 18. A valve assembly 20 is operative in timed relation to the movement of the suction head 18 such that as the suction head 18 moves forward from its position shown by full lines in FIG. 1, valve assembly 20 couples the suction head 18 to the suction tank 15 so that the suction head lockingly engages the lowermost blank 12 and moves the same toward the rolls 13 and 14. The valve assembly 20 is also operative to vent the shuttle head 18 as the latter approaches its forward position shown by broken lines in FIG. 1 whereby the blank 12 may be engaged by the nip of rolls 13 and 14 and moved into the subsequent processing machinery. The rear portion of the blanks 12 rest on an adjustable support assembly 24 while the forward ends of the blanks 12 engage one or more vertically adjustable elongate stop members 27 whose lower ends are disposed a distance above the upper surface of shuttle 16 which is slightly greater than the thickness of each of the blanks 12.

The shutttle 16 includes a hollow, open-ended cylindrical body member 30 telescopingly received on a cylindrical, tubular, open-ended valve support member 31 which extends horizontally through and is affixed is aligned circular apertures 32 and 33 formed respectively in the one wall 34 of the valve mechanism frame 35 and a support plate 36 affixed to said wall. Support member 31 extends toward the feed rolls 13 and 14 and its other end terminates in a valve seat 37 for cooperating with one of the valves 38 of the valve assembly 20. An annular seal 39 is affixed to one end of the body member 30 and the opposite end thereof is received in a lower portion of a vertically oriented shaped plate 40 disposed intermediate the ends of the shuttle assembly 16. The suction head 18 extends forwardly from the upper end of plate 40 and includes a perforated top plate 42 and a bottom plate 44 spaced from the top plate 42 to define a first portion of a plenum chamber 45 therebetween and which is enclosed by generally vertical side plates 46. The rear edge of the bottom plate 44 is spaced from the plate 40 and merges with a generally downwardly extending plate 47 which is spaced from and is parallel to plate 40. The lower end of plate 40 is shown in FIG. 2 to be generally semicircular while the upper end thereof flares outwardly to the lower edges of the side plates 46. The gap between plates 40 and 47 are enclosed by side members 50, 51 and 52 which are configured as viewed in FIG. 2 to define a second portion of plenum chamber 45.

The shuttle 16 is mounted on the support frame 15 for longitudinal low frictional movement by means of roller bearings 53. While any suitable roller bearings may be employed, in the illustrated embodiment, the bearings 53 each include an elongate hollow tubular member 54 which is generally square in transverse cross-section and which has a pair of rollers 55 and 56 disposed at each end and each of which extends through a different pair of opposite sides. The bearings 53 are disposed between elongate angle members 57 affixed to and extending longitudinally along the sides of shuttle 16 and a complementary angle track member 58 affixed to the frame 15 and extending in parallelism with the angle members 57. It will be appreicated that the rollers 55 and 56 are pinned in the tube 54 for rotation about axes which are each normal to a different pair of opposite sides of the tube 54 so that roller 55 (and its counterpart at the opposite end of the tube 54) engage opposed faces of the angle member 57 and track member 58 while the roller 56 engages the other two opposed faces of said members. It will also be appreciated that means (not shown) are provided to retain the bearings 53 between members 57 and 58.

In addition to the front wall 34, the valve mechanism frame includes a top panel 59, a rear panel 60 and the side panels 61. The open end of the tubular support 31 is coupled to the suction tank 15 by an enclosure 15*a* consisting of a panel 62 spaced from wall 34 and curved outwardly at its upper end for being welded to a vertical plate 63. Panel 62 and plate 63 are suitably affixed in a sealing relation to the panels 59 and 61. It will be appreciated that the vacuum surge tank 15 and enclosure 15*a* will be coupled to a vacuum pump (not shown) or other suitable evacuator so that vacuum pressure will be maintained therein as well as within the interior of the tubular support 31.

The valve assembly 20 includes the vacuum valve 38 for coupling the plenum chamber 45 to the surge tank 15 when it is desired to have the suction head 18 secure one of the panels 12 and a dump valve 64 for venting the plenum chamber 45 to atmosphere when it is desired to release the blank 12. In order to maintain the vacuum within tank 15, the valves 38 and 64 are controlled to open only when the other is closed. It will be appreciated that the vacuum applied below the perforated top plate 42 will result in the blank 12 thereabove to be held against the shuttle head 18 by the ambient air pressure.

The shuttle 16 is reciprocated in timed relation to the speed of the feed rolls 13 and 14 by means of a drive assembly 66 (FIG. 1) to which it is coupled by an elongate link 68 having one end pivotally connected at 70, to a bracket 71 affixed to plate 47 and cylindrical body member 30. The other end of link 68 is pivotally connected at 72 to the free end of a rocker arm 73, the other end of which is affixed to a shaft 75 which is journaled for rotation in fixed bearings (not shown). The lever 73 has an elongate slot 76 formed intermediate its ends and in which is disposed a roller 78 rotatably mounted at one end of arm 79, the other end of which is affixed to a shaft 81. A gear 82 is affixed to shaft 81 and is coupled by any suitable means (not shown) to the main drive mechanism of the fabricating apparatus so that gear 82 and shaft 81 have a rotational speed related to that of the rolls 13 and 14. It can thus be seen that as gear 82 rotates through one revolution the rock lever 73 will pivot forwardly and backwardly between its positions shown by broken lines in FIG. 1 whereby the shuttle 16 will similarly cycle between its positions shown by full and broken lines. It will be appreciated that if the apparatus being fed is a printer, for example, the shuttle should cycle once for each revolution of the printing rolls so that the gear 82 will rotate at printing roll speed.

The valve 38 is shown in FIG. 1 to include a valve member 85 affixed to the end of a stem 86 which extends coaxially into and is supported for axial sliding movement within an axiially extending support 87 affixed by webs 88 within support member 84 and adjacent the valve seat 37. A valve operating mechanism 89 is disposed within the valve mechanism frame 35 and is coupled to the end of stem 86 by means of a connecting rod 90 for opening the valve 85 during each cycle of the shuttle 16 and against the biasing force of a valve return spring 91. Rod 90 extends through a suitable seal 92 in plate 63 which maintains the vacuum in enclosure 15*a*.

Referring now to FIGS. 1 and 2, the valve operating mechanism 89 is shown to include a linkage assembly 93 and rotating cams 94 and 95. The linkage assembly 93 has a pair of generally parallel, spaced apart links 96 which are each pivotally mounted at their upper ends on pivot pins 97 which are fixed in the valve mechanism frame 35. Each of the links 96 carries an apertured bearing 99 at its lower end for rotatably receiving the ends of a pin 100 which extends therebetween. A rocker arm 102 is pivotally supported on pin 100 and includes a pair of elongate, spaced apart members 103. A first pin 105 pivotally connects the upper ends of the members 103 to an eyelet 106 mounted on the end of operating shaft 90 and a second pin 108 joins the lower ends of members 102 and forms an anchor for a clevis 109 mounted on the end of a compression spring 110 the other end of which is anchored to the wall 60. The compression spring 110 tends to pivot the rocker arm 102 in a clockwise direction about pin 100 as viewed in FIG. 1 and aids spring 91 in biasing valve 38 toward a closed position.

A first roller 112 is rotatably mounted on pin 100 and between the members 103 and a second roller 113 is mounted between said members and below roller 112 on a pin 114 which extends between members 103 and is located intermediate the pins 100 and 108. As seen in FIG. 2 the members 103 may be retained in spaced apart relation by webbing portions 115 located at various points therealong.

The cams 94 and 95 are respectively mounted on shafts 116 and 117 and each shaft is coupled to the apparatus prime mover (not shown) as will be described below, whereby the cam 95 will rotate twice for each cycle of shuttle 16 and cam 94 will rotate through one-half revolution for each shuttle cycle so that the cam 95 rotates at four times the rate of cam 94. The surface 118 of cam 95 engages roller 112 and has a generally annular configuration except for a larger diameter lifting lobe portion 119. The surface of cam 94 has two spaced apart small diameter portions 120 and 121 and two large diameter lifting lobe portions 122 and 123 disposed therebetween.

It will be appreciated that as cam member 95 rotates in a counterclockwise direction as viewed in FIG. 1, it will tend to urge the pin 100 and the lower end of links 102 toward the left twice during each cycle of the shuttle 16. As can also be seen with reference to FIG. 1, when the lifting lobe portion 119 of cam 95 engages the roller 112 the roller 113 may be in engagement with either one of the small diameter surfaces 120 or 121 of cam 94 or one of the large diameter surfaces 122 or 123 thereof. If the lifting lobe portion 119 of cam surface 118 engages roller 112 when the roller 113 is in engagement with one of the large diameter surfaces 122 or 123 as shown by full lines in FIG. 1, the rock lever 102 will pivot in a counterclockwise direction about pin 114 moving the connecting rod 90 toward the left and the valve element 85 from its closed position shown by full lines in FIG. 1 to its open position thereby coupling the plenum chamber 45 to vacuum surge tank 15. On the other hand, since roller 113 is always forced to follow the profile of cam 94 by spring 110, whenever roller 113 is in regions 120 or 121 of said cam, roller 113 is moved away from cam 95 just far engough so that surface 119 of cam 95 cannot contact roller 113. As a result, rocker arm 103 does not actuate push rod 90 so that valve 38 remains closed.

Figure 3A:
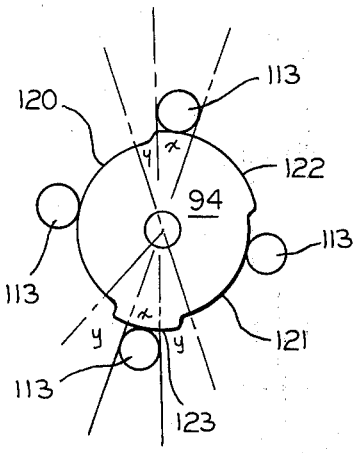
Figure 3B:
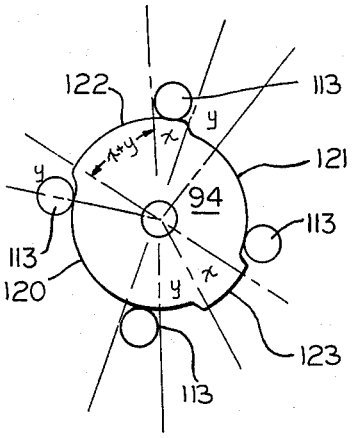
Figure 3C:
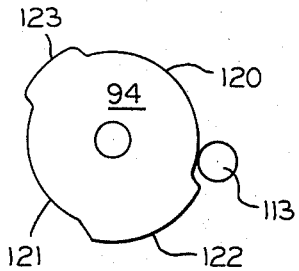

As will be described more fully below, the shaft 116 is coupled to the apparatus prime mover (not shown) by means of a clutch such that the cam 94 can be coupled to the drive mechanism in each of three angular positions relative to the cycle of the shuttle 18 and the cam 95. By angularly adjusting the cam 94, the positions of the surfaces 120, 121, 122 and 123 can be modified relative to the cycle of the cam 95. In this manner the shuttle 16 may be coupled selectively to the vacuum system during each cycle, during alternate cycles or the valve 38 can be maintained in a closed position as the shuttle 18 cycles. FIGS. 3*a*, 3*b*, and 3*c* illustrate the relative angular positions of cams 94 and 95. It will be recalled that the cam 94 rotates at one-quarter the speed of cam 95 so that the latter will attempt to initiate a feeding operation as described above four times for each revolution of cam 94 or twice during each cycle of shuttle 16. The positions of roller 113 relative to cam 94 when the surface 119 of cam 95 attempts engagement with roller 112 are shown in FIGS. 3A, 3B and 3C for each of four angular positions of cam 94. Each such angular position is identified by the four positions of roller 113 in FIG. 3A which are equi-spaced apart about the profile of cam 94. More specifically, cam 94 is configured such that when it is in the angular position shown in FIG. 3A, the surfaces 122 and 123 are each in position to be engaged during alternate attempts by cam 95 to engage roller 112 so that a suction operation will occur during each cycle of the shuttle 16. In FIG. 3B, the cam 94 is shown to be coupled to the drive in an angular position which is displaced counterclockwise from that shown in FIG. 3A so that roller 113 will engage the opposite ends of surface 120 and surfaces 122 and 123 when cam 94 attempts to effect a valve operation. In this mode a feed operation occurs only when roller 113 engages surface 122 or during alternate shuttle cycles. A further mode of operation is illustrated in FIG. 3C wherein the cam 94 is stopped in a position such that roller 113 is always on cam surfaces 120 or 121 as cam 95 rotates whereby cam 95 is prevented from operating valve 38 and there is no feeding of sheets 12.

While the mode of operation just described provides for a two-to-one ratio of cam 95 rotation to shuttle cycle, it will be appreciated that other ratios could also be employed. For example, a ratio of one-to-one could be employed with the illustrated cam profiles. However, the two-to-one ratio is preferable over a one-to-one ratio because it provides twice the valve 38 opening acceleration. This provides more precise valve timing. Also, the flywheel 124 affixed to shaft 117 will have four times the kinetic energy when driven twice as fast, resulting in much smaller fluctuations in angular speed of the cam shaft 117 during each valve opening cycle.

The angular extent of each of the surfaces 120, 121, 122 and 123 of cam 94 and their relative positions are determined by the angular rotation of said cam in relation to the range in which the shuttle 16 is in position for suction to be applied. Assume, for example, that this range will coincide with a rotational angle of $x$ as shown in FIG 3A. The surface 123, therefore, must intercept at least this angle identified as $x$ in FIG. 3A and in addition, the transition portions between surface 123 and surfaces 120 and 121 will intercept angles $y$ as shown in FIG. 3B. In practice, when angle $x$ is 22.5°, angles $y$ of about 25° have been found to provide the desired effect. In order to insure that the alternate cycle operation is achieved, the cam 94 must be reoriented in a counterclockwise direction of rotation through an angle equal to the shuttle suction range angle or angle $x$ plus an angle equal to the transition angle between surfaces 120 and 123 or the angle $y$. Thus, the cam in FIG. 3B is reoriented counterclockwise through an angle of $x + y$ or 47.5° in the example from its position shown in FIG. 3A. Also, so that roller 113 remains in engagement with surface 122 when the cam 94 has been reoriented in this manner, the surface 122 must intercept an angle equal to that intercepted by the surface 123 plus the angle of reorientation from FIG. 3A to FIG. 3B. Accordingly, surface 122 will intercept an angle of $x + (x + y)$. In addition, surface 122 will include the two transition surfaces intercepted by angles $y$ as indicated in FIG. 3B. The total radial angle of surface 122 is, therefore, $2x + 3y$.

It will be appreciated that the cam 92 may be coupled to the apparatus prime mover (not shown) by any brake-clutch which is capable of engaging with a high degree of angular precision. One such clutch is the model CB8 Wrap Spring Clutch and Brake with anti-overrun manufactured by PSI Division of Warner Electric Brake Co. Such a clutch coupling arrangement is schematically illustrated in FIG. 4. Here, a first gear 129 is mounted on the shaft 130 which is coupled to the apparatus prime mover for being continuously driven. A second gear 131 is mounted on a shaft 132 and meshes with gear 129. The tooth ratio of gears 129 and 131 is such that shaft 132 rotates at one half the speed of shaft 130. A second gear 133 mounted on shaft 130 meshes with gear 134 mounted on shaft 117 which also carries cam 95. The ratio of gear 134 to 133 is such that cam shaft 117 operates at twice the speed of input shaft 130. A clutch operating mechanism 135 is provided for selectively operating wrap spring clutch 137 so as to couple in a predetermined angular relation shaft 132 to the shaft 116 which carries cam 94. The clutch actuating mechanism 135 includes a latch member 138 which normally holds the clutch inactive so that shaft 116 is uncoupled from shaft 132. A brake 139 is also coupled to shaft 116 for stopping the same whenever clutch 137 engages latch member 138. In addition, a disc 140 having an aperture 141 adjacent its periphery is affixed to the shaft 132 and is rotatable therewith. Two lamps 142 and 144 are disposed on one side of disc 140 at the same radial distance as aperture 141 and spaced apart angularly in the same relation as the angles through which cam 94 is displaced between its various positions shown in FIGS. 3A and 3B. Two photocells 147 and 148 are also disposed in the opposite side of disc 140 and spaced apart in the same relation as lamps 142 and 144. Each of the lamps and photocells are coupled to a control 152 which may be of any well-known type and accordingly, is only schematically illustrated. The control may include, for example, switches 153 and 154 each of which is disposed between a battery 158 and lamps 142 and 144 respectively. Each of the photocells 147 and 148 are connected in parallel to each other and to a switching circuit device 159 which is operative to couple the battery 158 to a solenoid 160 when it receives a signal from any of the photocells 147 or 148. The solenoid 160 is operative when energized to move the latch 138 out of engagement with the clutch 137 and against the reset spring 162. In operation, when it is desired to initiate full cycle operation the switch 154 is closed whereby lamp 144 will be energized. In this event, photocell 148 will be energized when the aperture 141 in disc 140 reaches a first angular position wherein it is in alignment between lamp 144 and photocell 148. On energization of photocell 148 the solenoid 160 will be energized to move latch 138 out of blocking engagement with the wrap spring clutch 137 and the latter will then couple shaft 132 to shaft 116 whereby cam 94 will begin rotating in a predetermined angular relation relative to movement of shuttle 16 and corresponding to FIG. 3A. Similarly, when it is desired to initiate aleternate cycle operation, switch 153 will be closed to actuate clutch 137 in a similar manner through the operation of switch 153, lamp 142 and photo-cell 147 for coupling shafts 132 and 116 in a second angular relation corresponding to FIG. 3B.

If it is desired to maintain the valve 38 in an inoperative position, switch 156 will be opened to release latch 138 for engaging clutch 137. Latch 138 is oriented relative to cam 94 such that whenever latch 138 engages clutch 137, brake 139 stops cam shaft 116 so that cam roller 113 rests on one of the surfaces 120 or 121 of cam 94 as shown in FIG. 3C. This provides an "off" or non-functional mode for valve 38.

Another embodiment of the invention is shown in FIGS. 5 and 6 to include a mechanical assembly 158 for coupling prime mover input shaft 130 to the cam 94 shaft 116 and a cam 95 shaft 117. The shaft 130 is shown in FIG. 5 to be driven by the apparatus prime mover (not shown) at the same frequency as the shuttle 16. A gear 133 is mounted on shaft 130 and engages a gear 159 which is coupled to the cam 95 shaft 117 by a conventional torsionally flexible coupling 160. The ratio of gears 133 and 159 is such that shaft 117 is driven at twice the shuttle frequency. The torsionally flexible coupling 160, in conjunction with the fly wheel 124, provides a degree of torsional vibration isolation of cam shaft 117 from drive shaft 130. This provides isolation of the severe angular velocity fluctuations of shaft 117 due to the energy transfer into and out of cam 95 during the operation of valve 38. To further minimize this effect, tortional damping may also be used in conjunction with flexible coupling 160.

Shaft 130 also drives a collar 161 which is at the input end of precision wrap spring clutch device 162 of the type well known in the art, and which includes a clutch **162*a* and a brake 166. Clutch 162*a* is operative when engaged for driving a hollow shaft 163. A gear 164 is mounted on hollow shaft 163 and meshingly engages a gear 165 mounted on cam 94 shaft 116. The gears 164, 165 are sized such that cam 94 rotates at one-half of shuttle frequency which is also one-quarter of the rotational speed of cam 95. When the clutch 162*a* is disengaged, the brake 166 mounted adjacent shaft 163** is operative for holding the latter in a predetermined angular position.

The assembly 158 also includes a latch lever 167 which is pivotally mounted about a fixed pin 168 and carries a latch 169 intermediate its ends for engaging a stop dog 170. Clutch brake **162*a* is operative whereby when the latch 169 engages the stop dog 170, the clutch 162*a* releases the shaft 163 from coupling engagement with shaft 130 and simultaneously brake 166 stops shaft 163 at a point accurately predetermined by the relative angular position of stop 170. This point is set to stop cam 94 relative to cam roller 113 so that valve 38 cannot be actuated by cam 95** to provide the off mode of operation previously discussed.

A tripping assembly for the latch lever 167 is shown in FIGS. 5 and 6 to include a timing disk 171 mounted on shaft 130 for rotation therewith and having a pair of trip dogs 172 and 173 oriented 180° apart and each of which is mounted on one of the opposite sides of disk 171. A pair of trip solenoids 175 and 176 are positioned adjacent the timing disk 171 and each respectively has a trip plunger 178 and 179 extending in general parallelism with each other and the opposite sides of the disk 171. When the solenoid 175 or 176 is energized, its respective trip plunger 178 or 179 is movable toward the right as viewed in FIG. 6 and into a trip position in the path of one of the trip dogs 172 or 173 as shown by broken lines in FIG. 6. Each trip plunger is articulated about a pin 177 at its end for pivotal movement of its outer portion in the plane of FIG. 6. Return springs (not shown) are associated with each of the trip plungers 178 and 179 for returning them to their linear and retracted positions shown by full lines in FIG. 6 when their respective solenoids are de-energized. The trip assembly also includes a trip lever 181 pivotally mounted about a fixed pin 182 and extending generally normally to and below latch lever 167.

When solenoid 175, for example, is energized, plunger 178 will move toward the right as viewed in FIG. 6 and into the path of the trip dog 173. When the timing disk 171 rotates to a position wherein trip dog 173 engages the end of plunger 178 which pivots upwardly to pivot trip lever 181 clockwise as viewed in FIG. 5 thereby pivoting latch lever 167 counterclockwise as viewed in FIG. 6 to move latch 169 out of engagement with stop dog 170 and against the action of a return spring 184. An electromagnetic coil 185 is positioned adjacent the end of latch lever 167 and is operative when energized and upon movement of lever 167 out of its latching engagement to hold lever 167 in its pivoted position and against the action of return spring 184. It will be understood, however, that the magnetic attraction of coil 185 on lever 167 will be insufficient to move said lever out of its latched position but is solely capable of holding the lever in its pivoted position until solenoid 185 is de-energized whereupon spring 184 will return lever 167 to its position shown by full lines in FIG. 6.

It will be appreciated that because timing disk 171 is affixed to shaft 130 it bears a fixed angular relationship to gear 133 which drives cam 95. Also, because trip dogs 172 and 173 are 180° apart on disk 171, they are also maintained at a fixed angular relationship to each other and to gear 133. Because gear 159 rotates through a complete revolution while gear 133 rotates through 180°, it will be appreciated that when either of the trip dogs 172 or 173 contacts its respective trip plunger 178 or 179, cam 95 will be in either one of two predetermined angular positions. When it is desired to change the mode of operation or to initiate the stop mode, solenoid 185 is deenergized so that lever 167 may be returned to its latching position by spring 184. The clutch 162*a* will continue to rotate, however, until the stop dog 170 moves into engagement with the latch 169. At this point, the clutch 162 will be disengaged and brake 166 will simultaneously stop shaft 163 and consequently cam 94 at a predetermined angular position. It will be appreciated that because for each revolution of stop dog 170 cam 94 turns one-half revolution, there are two possible precise angular stop positions for cam 94 as shown in FIGS. 7A or 7B. In either of such positions of cam 94, it will be so related to roller 113 that valve 38 cannot be actuated by cam 95 to provide the off mode of operation for the apparatus.

Similarly, because timing disk 171 is affixed to shaft 130, its angular relation to gear 133 and consequently cam 95 is fixed. As a result, the trip dogs 172 and 173 on disk 171 are also maintained in a fixed angular relation to cam 95 so that when the trip dog 172, for example, contacts plunger 178, the cam 94, which rotates at one-half the rotational speed of disk 171, may be in one of two angular positions relative to cam 95 as shown in FIGS. 7C and 7D. In a like manner, when trip dog 173 contacts plunger 179 to initiate alternate cycle operation, cam 94 may be in one of two angular positions relative to cam 95 as shown in FIGS. 7E and 7F.

In order to obtain the desired angular relationships between cams 94 and 95, it is necessary that any change from one operating mode to another must include, as its first condition, the stop mode configuration which is achieved by de-energized latching coil 185. In this manner, the stop dog 170 is permitted to rotate until it engages latch 169 so that the particular suction cycle is completed thereby and the possibility of interrupting a suction cycle prevented. This also provides a fail safe electrical power loss interlock since if coil 185 should become deenergized as a result of a power loss, the controller will not interrupt a suction cycle until it has been completed. Also, this interlocking action prevents actuation of a suction cycle until necessary manual preconditions are met so that misfeeding does not occur.

Initiation of a feeding mode of operation, either full cycle or half cycle is preferably, therefore, initiated by deenergizing the coil 185 so that the cam 94 is stopped in one of its positions shown in FIGS. 7A or 7B. One or the other of the solenoids 175 or 176 are then energized depending upon whether full mode or half mode operation is desired and the coil 185 is simultaneously energized. The plunger 178 or 179 of the energized solenoid will be engaged by its associated trip dog 172 or 173 so that the latch lever 167 will be pivoted upwardly and retained in its trip position by coil 185. The energized solenoid 175 or 176 will then be deenergized.

While only two schematic control arrangements have been illustrated, those skilled in the art will appreciate that any electrical, mechanical or pneumatic control system may also be employed.

The vent valve 64 is shown in FIGS. 2 and 8 to be similar to the vacuum valve 38 and includes a valve element 187 which cooperates with a valve seat 188 mounted in plate 40. In addition, an axially extending valve stem 189 is coupled to valve element 187 and is supported for axial reciprocal sliding movement by a suitable support 190. A spring 185 extends between a spring retaining flange 191 affixed adjacent the end of stem 189 and support 190 and urges the valve 64 toward a closed position. The other end of valve stem 189 also includes a flat end face bearing against a roller 192 on one arm 193 of a crank 194 which is pivotally mounted at 195 to angle member 57 mounted on shuttle 16. The other arm 196 of crank 194 carries a roller 197 at its free end for cooperatively engaging a cam track 198 which is affixed to the frame 15. Track 198 has a first portion 198*a* which corresponds to the rearmost position of the shuttle 16 and a second portion 198*b* which is elevated relative to the portion 198*a* and corresponds to the forward position of the shuttle 16. When the shuttle 16 is in its rearmost position relative to the rolls 13 and 14, the roller 197 will be on surface 198*a* and valve 64 will be closed. As the shuttle 16 moves forward, the roller 197 will move from the surface 198*a* onto the surface 198*b* causing the crank 194 to rock counterclockwise as viewed in FIG. 6 thereby moving the valve 64 to its open position wherein the plenum chamber will be vented to atmosphere and the blank 12 being held by shuttle head 18 will be released. When the shuttle 16 traverses to its rearmost position after release of the blank 12, the roller 197 will move from the surface 198*b* onto the surface 198*a* whereupon the crank 194 will rock clockwise as viewed in FIG. 8 and the valve 64 will be closed. The track 198 will be configured such that the valve 64 will open and close in timed relation to the opening and closing of vacuum valve 38.

FIG. 9 illustrates the relation between the advance of shuttle 16 and the operation of the vacuum valve 38 and the vent valve 64 in relation to apparatus having print rolls where the shuttle 16 completes one cycle for each revolution of the print rolls. It can be seen that the valve 38 will begin opening to connect the shuttle plenum chamber 45 to the vacuum enclosure 15*a* before the shuttle returns to its full retract position. The vacuum valve 38 will be fully opened shortly after the shuttle begins its forward advance and will remain open until the shuttle 18 has traveled to about 20% of its forward advance. At this point the vacuum valve 38 begins closing and will be fully closed when the shuttle 18 has moved about 30% of its forward traverse and after about 10% further travel, the vent valve 64 will begin opening whereby the blank 12 is released after about 50% forward travel and whereby the shuttle speed matches that of the rollers 13 and 14 which then pick up the blank 12. The vent valve 64 remains open until the shuttle has reversed its direction and has moved to a position slightly past the midpoint of its rearward traverse after which the next succeeding cycle commences.

FIGS. 10 and 11 illustrate an alternate embodiment of the invention wherein a rotary valve assembly 200 is provided for coupling the plenum chamber 45' of shuttle 16' to the vacuum surge tank 15 and for venting the same to atmosphere. In general, the assembly 200 includes a stationary, hollow member 201 which is oriented generally horizontally in the direction of shuttle travel. The member 201 has a generally cylindrical portion 202 which is affixed at one end to the support frame by an annular supporting member 33' and which acts as a guide and support for the cylindrical body portion 30' of shuttle 16. In addition, the member 201 includes a portion 203 which tapers downwardly toward a smaller diameter end from the forward end of the portion 203. An axially extending, longitudinal slot 205 is formed in the portion 203 and intermediate the ends thereof. The valve assembly 200 also includes a first outer hollow rotatable valve member 207 disposed within and concentric with the stationary member 202 and a second concentric rotatable hollow valve member 208 which is disposed within the valve member 207. Valve member 207 has a tapered head portion 210 which is rotatably disposed within and engages the inner surface of the tapered portion 203 of stationary member 201. The portion 203 therefore acts as a bearing support for the tapered valve portion 210. Extending rearwardly from the bearing portion 210 is a hollow cylindrical section 212 which is open ended and which is supported by a stationary bearing 214. The second valve 208 is hollowed and tapered with its outer surface having the same configuration as the inner surface of the tapered valve portion 210. The smaller diameter end 216 of valve 208 is affixed to an axially extending shaft 217 whose opposite end is rotatably supported in bearing 218. The larger diameter end of valve member 208 is open and communicates with the interior of the cylindrical portion 212 of valve member 207. The valve head portion 210 of valve 207 and valve member 208 have longitudinal slots 220 and 221, respectively, and each of which extends therethrough and have substantially the same radial angle and axial extent as slot 205. As seen in FIG. 11, the slots 205, 220 and 221 are shorter than the tapered portion 203 of stationary support 202 so that the ends of the slots are isolated from the space 223 between the concentric cylindrical members 202 and 212. Valve member 210 also has a second longitudinal slot 224 formed in its outer surface but which does not extend therethrough. Slot 224 does, however, extend laterally through the large diameter end of head 220 so that it communicates with the gap 223 between members 202 and 212.

The valve members 207 and 208 are rotated by means of a gear drive assembly 230 which includes a first drive gear 231 mounted on a shaft 232 and which meshingly engages with a ring gear 234 mounted on the end of the cylindrical portion 212 of member 207. A second pair of gears 236 and 237 are affixed to a central hub 239 which is keyed to shaft 232 and which is movable axially of said shaft by means of a standard shift apparatus which is not shown but which is well known to the art. In addition, a second pair of gears 241 and 242 are mounted on the shaft 217 which in turn is coupled to the main apparatus drive by a wrap spring clutch and brake 244. The hub 239 is shiftable so that it may be positioned with gear 236 meshing with gear 241 or gear 237 meshing with gear 242. In addition, the distance between gears 236 and 237 is such that when hub 239 is in a central position the gears 236 and 237 will be out of engagement with gears 241 and 242 so that shaft 232 will be inactive. The ratio of gear teeth in the gears 236, 237, 241, 242, 231 and 234 are such that when gear 236 meshes with gear 241 the valve member 208 will rotate five-fourths the speed of valve 207. This means that the slots 221, 220 and 205 can come into coincidence once each four revolutions of valve 207. Since valve 207 revolves twice for each shuttle 16 cycle, chamber 45 can be evacuated on alternate cycles. On the other hand, when gear 237 engages gear 242, the valve member 208 will rotate at one and one-half the speed of valve member 207. Thus, slots 221, 220 and 205 can be made to come into coincidence once each two revolutions of valve 207. Since valve 207 rotates twice each shuttle cycle, chamber 45 can be then evacuated once each shuttle cycle.

In operation of the embodiment of FIGS. 10 and 11, either the half cycle, full cycle or valve-off mode is selected by positioning the hub 239. The clutch 244 will then be operated to couple the shaft 217 to gears 241 and 242 which are coupled to the apparatus prime mover (not shown) through shaft 232 and which shaft rotates at twice shuttle frequency. If full cycle operation is desired, hub 239 will be positioned with gear 237 engaging gear 242, and clutch 244 will be actuated in correct timing to allow the slots 205, 220 and 221 to be in alignment at the beginning of each cycle. When the slots 205, 220 and 221 are in alignment the suction head 18' will be in communication with the vacuum surge tank 22' through the interior of member 208, the interior of cylindrical portion 210, and out the open end thereof as indicated by arrows 250. During each revolution of the valve member 207, the groove 224 will pass under the slot 205 which will couple the suction head 18' to atmosphere through the gap 223 between cylindrical portions 207 and 202. This will occur in timed relation to the shuttle cycle and vacuum application as indicated in FIG. 9.

It will be appreciated that if alternate cycle operation is desired, hub 239 is positioned to engage gears 241 and 236. Also, if it is desired to place the apparatus in a valve closed position, the hub 239 is placed in an intermediate position whereby the gears 236 and 237 are out of engagement with gears 241 and 242 so that the valve 208 remains inactive and in a blocking position between slots 205 and 221.

Normal full cycle operation limits the length of blank that can be fed into the apparatus because the trailing edge of the blanks 12 must pass the suction head by the time the shuttle 16 begins the next cycle. The blank speed, however, is relatively fixed by the speed of the feed rolls 13 and 14. The skip cycle feature of the invention permits the feeding of blanks which are longer than one print roll circumference.

While only a few embodiments of the invention have been illustrated and described, it is not intended to be limited thereby but only by the scope of the appended claims.

I claim:

1. Apparatus for feeding blanks into process machinery and including a suction means for engaging said blanks and operative when subjected to a vacuum to grip a blank, translating means for cyclically reciprocating said suction means in relation to said apparatus, evacuating valve means for coupling said suction means to a source of vacuum, valve operating means for opening and closing said valve means in timed relation to the cycle of said suction means, said valve operating means including selectively operable adjustment means for rendering said valve operating means effective for selectively opening said valve means during each cycle of said suction means or during alternate cycles thereof said valve operating means including cyclic means cyclically operable in functional relation to the cycle of said suction means, said valve operating means being effective to open said evacuating valve means when said cyclic means is in a predetermined phase of its cycle, said adjustment means being selectively operable to modify the phase of said cyclic means so that said cyclic means is in its operative phase during each cycle of said suction means or during alternate cycles thereof.

2. The apparatus set forth in claim 1 and including second valve means for venting said suction means to atmosphere, said valve operating means also being operative to open and close said second valve means in timed relation to the cycle of said suction means and the opening and closing of said evacuating valve means.

3. Apparatus for feeding blanks into process machinery and including a suction means for engaging said blanks and operative when subjected to a vacuum to grip a blank, translating means for cyclically reciprocating said suction means in relation to said apparatus, evacuating valve means for coupling said suction means to a source of vacuum, valve operating means for opening and closing said valve means in timed relation to the cycle of said suction means, said valve operating means including selectively operable adjustment means for rendering said valve operating means effective for selectively opening said valve means during each cycle of said suction means or during alternate cycles thereof, second valve means for venting said suction means to atmosphere, said valve operating means also being operative to open and close said second valve means in timed relation to the cycle of said suction means and the opening and closing of said evacuating valve means, said valve operating means including cam means extending in the direction of suction means travel and cam follower means coupled to said second valve means, said cam means being configured such that said cam follower means will effect the opening of said second valve means after said suction means has moved a predetermined distance towards said process machinery and wherein said cam follower will close said second valve means during return movement of said suction means away from said machinery.

4. The apparatus set forth in claim 3 wherein said cam follower means includes crank means pivotally mounted on said suction means, said crank means having one end coupled to said second valve means and the other end engageable with said cam means, said cam means having first and second cam surfaces, said crank means pivoting to open said valve means when the other end thereof moves from said first cam surface to said second cam surface and pivoting to close said second valve means when the other end of said crank means moves from said second cam surface to said first cam surface.

5. The apparatus set forth in claim 4 wherein said suction means includes a perforated plate constructed and arranged for engaging the lower surface of a blank disposed thereabove, chamber defining means mounted below said perforated plate, an elongated generally horizontally extending tubular member communicating at one end to said vacuum source, said evacuating valve means closing the other end of said tubular member, and sleeve means slidably mounted on said tubular member and coupled to said chamber, said tubular member comprising the support for said suction means, connecting means for coupling said evacuating valve means to said valve operating means, said second valve means being mounted on said chamber defining means for venting the same to atmosphere.

6. The apparatus set forth in claim 1 wherein said adjustment is also selectively operable for disabling said evacuating valve means for preventing the operation thereof.

7. Apparatus for feeding blanks into process machinery and including a suction means for engaging said blanks and operative when subjected to a vacuum to grip a blank, translating means for cyclically reciprocating said suction means in relation to said apparatus, evacuating valve means for coupling said suction means to a source of vacuum, valve operating means for opening and closing said valve means in timed relation to the cycle of said suction means, said valve operating means including selectively operable adjustment means for rendering said valve operating means effective for selectively opening said valve means during each cycle of said suction means or during alternate cycles thereof, said suction means including a perforated top plate constructed and arranged for engaging the lower surface of a blank disposed thereabove, means defining a chamber below said perforated plate, an elongated generally horizontally extending tubular member communicating at one end to said vacuum source, valve means closing the other end of said tubular member, and sleeve means slidably mounted on said tubular member and coupled to said chamber, said tubular member comprising the support for said suction means, connecting means for coupling said evacuating valve means to said valve operating means.

8. Apparatus for feeding blanks into process machinery and including a suction means for engaging said blanks and operative when subjected to a vacuum to grip a blank, translating means for cyclically reciprocating said suction means in relation to said apparatus, evacuating valve means for coupling said suction means to a source of vacuum, valve operating means for opening and closing said valve means in timed relation to the cycle of said suction means, said valve operating means including selectively operable adjustment means for rendering said valve operating means effective for selectively opening said valve means during each cycle of said suction means or during alternate cycles thereof, said valve operating means including first and second means each being cyclically operable in functional relation to the cycle of said suction means, said valve operating means being effective to open said evacuating valve means when said first and second means are simultaneously in predetermined respective phases of their cycles, said adjustment means being selectively operable to modify the phase relationship of said first and second means so that said first and second means may be in said predetermined respective phases during each cycle of said suction means or during alternate cycles thereof.

9. The apparatus set forth in claim 8 wherein said first and second means are each rotatably mounted, drive means for simultaneously rotating said first and second means in a timed relation to the cycle of said suction means and to each other, said first and second means being operable to actuate said evacuating valve means when said first and second means are simultaneously in predetermined angular positions during their respective cycles, said adjustment means being operable to modify the angular relation of said first and second means.

10. The apparatus set forth in claim 9 wherein said first and second means comprise first and second rotating cam means each having an operative area, coupling means for coupling said first and second cam means to said evacuating valve means and disposed to be engaged by said cam means as the latter rotates, said coupling means being operative to open said valve means when simultaneously engaged by said operative areas of said cam means.

11. The apparatus set forth in claim 10 and including second valve means for venting said suction means to atmosphere, said valve operating means also being operative to open and close said second valve means in timed relation to the cycle of said suction means and the opening and closing of said evacuating valve means.

12. The apparatus set forth in claim 11 wherein said adjustment means is also selectively operable for modifying the angular relation of said first and second valve means such that said coupling does not simultaneously engage both of the operative areas of said cam means.

13. The apparatus set forth in claim 10 wherein said first cam means has a first generally annular cam surface and a larger diameter surface defining its operative area, said second cam means having a generally annular surface and a pair of spaced apart larger diameter surfaces which comprise the operative areas thereof, said drive means being operative to rotate said first cam means at a multiple of the rotational speed of said second cam means.

14. The apparatus set forth in claim 13 wherein said spaced apart surfaces include a first cam surface which intercepts a predetermined radial angle and a second cam surface offset a second predetermined angle from the diametrically opposite side of said first cam surface, said second cam surface intercepting a radial angle of twice said first predetermined angle plus said second predetermined angle.

15. The apparatus set forth in claim 14 wherein said coupling means includes pivotally mounted lever means having a first cam follower engageable with said first cam means and a second cam follower engageable with said second cam means, said lever means being pivotable in a first direction to open said valve means when each of said cam followers engages the operative areas of its associated cam means.

16. The apparatus set forth in claim 15 wherein said lever means is pivotally connected at one end to said valve means, one of said cam follower means being disposed adjacent the opposite end thereof and the other one of said cam follower means being disposed intermediate the ends thereof, said lever means also being pivotally mounted intermediate its ends on an elongate support, said support being pivotally mounted adjacent the one end of said lever means.

17. The apparatus set forth in claim 16 and including second valve means for venting said suction means to atmosphere, said valve operating means also being operative to open and close said second valve means in timed relation to the cycle of said suction means and the opening and closing of said evacuating valve means.

18. The apparatus set forth in claim 17 wherein said valve operating means includes cam means extending in the direction of suction means travel and cam follower means coupled to said second valve means, said cam means being configured such that said cam follower means will effect the opening of said second valve means after said suction means has moved a predetermined distance towards said process machinery and wherein said cam follower will close said second valve means during return movement of said suction means away from said machinery.

19. The apparatus set forth in claim 18 wherein said cam follower means includes crank means pivotally mounted on said suction means, said crank means having one end coupled to said second valve means and the other end engageable with said cam means, said cam means having first and second cam surfaces, said crank means pivoting to open said second valve means when the other end thereof moves from said first cam surface to said second cam surface and pivoting to close said second valve means when the other end of said crank means moves from said second cam surface to said first cam surface.

20. The apparatus set forth in claim 19 wherein said suction means includes a perforated top plate constructed and arranged for engaging the lower surface of a blank disposed thereabove, chamber defining means mounted below said perforated plate, an elongated generally horizontally extending tubular member communicating at one end to said vacuum source, said evacuating valve means closing the other end of said tubular member, and sleeve means slidably mounted on said tubular member and coupled to said chamber, said tubular member comprising the support for said suction means, connecting means for coupling said evacuating valve means to said valve operating means, said second valve means being mounted on said chamber defining means for venting the same to atmosphere.

21. The apparatus set forth in claim 19 wherein said selectively operable means includes clutch means for coupling one of said cam means to said drive means in a predetermined angular relation to the angular position of said other cam means.

22. The apparatus set forth in claim 9 wherein said first and second means respectively comprise first and second members which are hollow, said second member being disposed in concentric surrounding relation to said first member, said rotating members each having an opening formed therein, said openings being registerable when said first and second members are disposed in a predetermined relative angular position, the interior of said first means being coupled to one of said suction means and vacuum source and the exterior of said second member being coupled to the other one thereof whereby said suction means is coupled to said vacuum source when said openings are coincident.

23. The apparatus set forth in claim 22 and including a third member arranged concentrically with respect to said first and second members, said third means having an opening formed therein whereby said suction means and vacuum source are coupled when the openings in said first, second and third members are coincident, said second member having a groove formed therein, and sapced from the opening thereof, said groove being positioned to couple the opening in said third member to atmosphere when said second member is in a predetermined angular position whereby said suction means is vented.

24. The apparatus set forth in claim 23 wherein said adjustment means is also selectively operable for modifying the angular relationship of said first and second members whereby the same remain out of coincidence as said suction means cycles.

25. The apparatus set forth in claim 23 wherein said suction means includes a perforated top plate constructed and arranged for engaging the lower surface of a blank disposed thereabove, chamber defining means mounted below said perforated plate, an elongated generally horizontally extending tubular member communicating at one end to atmosphere, said third member being mounted on the other end of said tubular member, and sleeve means slidably mounted on said tubular member and coupled to said chamber, said tubular member comprising the support for said suction means, said second member including a tubular portion disposed within and spaced from said tubular member.

26. The apparatus set forth in claim 23 wherein said drive means includes gear means adapted to be coupled to said first and second members for effecting the rotation thereof at predetermined speeds relative to the suction means cycle, and shifting means for shifting said gear means to selectively couple different portions thereof to said first and second members for adjusting the relative speeds thereof wherein the openings therein are registered during predetermined multiples of the operation of said suction means and wherein said first and second members may be uncoupled from said gear means.

27. The apparatus set forth in claim 23 wherein said first, second and third members include generally tapered hollow portions disposed in concentric sliding relation, said openings being formed in said tapered portions, said first member being disposed within said second member and each of said members being open ended and communicating with said vacuum source; said third member being disposed in surrounding relation to said second member and having the exterior thereof exposed to said suction means, said second member having an exterior portion exposed to atmosphere and communicating with said groove.

28. The apparatus set forth in claim 27 wherein said suction means includes a perforated top plate constructed and arranged for engaging the lower surface of a blank disposed thereabove, chamber defining means mounted below said perforated plate, an elongated generally horizontally extending tubular member communicating at one end to atmosphere, said third member being mounted on the other end of said tubular member, and sleeve means slidably mounted on said tubular member and coupled to said chamber, said tubular member comprising the support for said suction means, said second means including a tubular portion disposed within and spaced from said tubular member.

29. The apparatus set forth in claim 28 wherein said selectively operable adjustment means includes clutch means for coupling one of said cam means to said drive means in a predetermined angular relation to the angular position of said other cam means.

30. Apparatus for feeding blanks into process machinery having feed rolls and including a suction means, support means for supporting said blanks above said suction means, said suction means being operative when subjected to a vacuum to grip the lowermost blank in said stack and for releasing the same in a timed relation, translating means for cyclically reciprocating said suction means toward and away from said feed rolls, valve means for venting said suction means when the latter is in a predetermined position relative to said feed rolls, evacuating means for coupling said suction means to a vacuum source, valve operating means coupled for opening and closing said valve means in timed relation to the cycle of said suction means, drive means coupled to said translating means for effecting the reciprocation of said suction means, and selectively operable adjustment means movable in cyclic relation to said suction means for effecting the operation of said valve operating means in timed relation to the reciprocation of said suction means, said adjustment means having a first cyclic mode wherein it is operative for effecting the opening of said valve means during each cycle of said suction means, said adjustment means having a second cyclic mode wherein it is operative for effecting the operation of said valve means during alternate cycles of said suction means and is inoperative to effect operation of said valve operating means during the remaining cycles thereof.

31. Apparatus for feeding blanks into process machinery having feed rolls and including a suction means, support means for supporting said blanks above said suction means, said suction means being operative when subjected to a vacuum to grip the lowermost blank in said stack and for releasing the same in a timed relation, translating means for cyclically reciprocating said suction means toward and away from said feed rolls, means for venting said suction means when the latter is in a predetermined position relative to said feed rolls, evacuating means for coupling said suction means to a vacuum source, valve operating means for opening and closing said valve means in timed relation to the cycle of said suction means, drive means coupled to said translating means for effecting the reciprocation of said suction means, selectively operable adjustment means for effecting the operation of said valve operating means in timed relation to the reciprocation of said suction means, said adjustment means having a first mode wherein said valve operating means effects the opening of said valve means during each cycle of said suction means, said adjustment means having a second mode for effecting the operation of said valve means during alternate cycles of said suction means, said adjustment means including cyclic means cyclically operable in timed relation to the reciprocation of said suction means, first and second selectively operable mode initiating means operatively associated with said cyclic means and each being effective for initiating a different one of said modes, said cyclic means being operative to delay the initiation of said first mode after the operation of said first actuating means until said cyclic means is in a first predetermined position of its cycle and for delaying the initiation of said second mode means after operation of said first actuating means until said cyclic means is in a second predetermined position of its cycle.

32. The apparatus set forth in claim 31 and including third selectively operable mode initiating means for preventing the operation of said valve means, said cyclic means being operative to delay the initiation of said third mode after operation of said third mode initiating means until said cyclic means is in a third predetermined phase of its cycle.

33. The apparatus set forth in claim 32 wherein said valve operating means includes first and second means each being cyclically operable in functional relation to the cycle of said suction means, said valve operating means being effective to open said evacuating valve means when said first and second means are simultaneously in predetermined respective phases of their cycles, said adjustment means being selectively operable to modify the phase relationship of said first and second means so that said first and second means may be in operative phases during each cycle of said suction means or during alternate cycles thereof.

34. The apparatus set forth in claim 33 wherein said cyclic means includes a rotatably mounted member coupled to said drive means for rotating in timed relation to the cycle of said suction means and to said first and second means.

35. The apparatus set forth in claim 34 wherein said first means is coupled to said drive means for rotation in timed relation to the cycle of said suction means and clutch means for selectively coupling said second means to said drive means for rotating said second means in timed relation to said first means and said suction means cycle, said first and second mode initiating means being operative to actuate said clutch means for coupling said second means in respective predetermined angular positions relative to said first means.

36. The apparatus set forth in claim 35 wherein said first and second selectively operable mode initiating means are positioned adjacent said rotatably mounted member and are normally inoperative to initiate said modes, said rotatably mounted member being effective when in a first predetermined angular position for rendering said first selectively operable mode initiating means effective and for rendering said second selectively operable mode initiating means effective when in a second angular position.

37. The apparatus set forth in claim 36 wherein said rotatable member has projecting means disposed thereon and spaced apart a predetermined radial angle, said first and second mode initiating means including first and second translatable means selectively movable into an operative position relative to said rotatable member, said first translatable means being disposed for operative engagement by said first projecting means when said rotatable member is in a first angular position and said second translatable means being disposed for being engaged by said second projecting means when said rotatable member is in a second predetermined angular position, said first and second translatable means being effective when engaged for respectively initiating said first and second modes.

38. The apparatus set forth in claim 37 wherein said first and second means comprise first and second rotating cam means, each of said cam means having an operative area, coupling means for coupling said first and second cam means to said evacuating valve means and disposed to be engaged by said cam means as the latter rotate, said coupling means being operative to open said valve means when simultaneously engaged by said operative areas of said cam areas.

39. The apparatus set forth in claim 38 and including second valve means for venting said suction means to atmosphere, said valve operating means also being operative to open and close said second valve means in timed relation to the cycle of said suction means in the opening and closing of said evacuating valve means.

* * * * *